US008171921B2

(12) United States Patent
Gillenberg et al.

(10) Patent No.: US 8,171,921 B2
(45) Date of Patent: May 8, 2012

(54) CRANKCASE VENTING SYSTEM

(75) Inventors: Eric Gillenberg, Speyer (DE); Wolfgang Heikamp, Waldsee (DE)

(73) Assignee: Mann + Hummel GmbH, Ludwigsburg (DE)

( * ) Notice: Subject to any disclaimer, the term of this patent is extended or adjusted under 35 U.S.C. 154(b) by 576 days.

(21) Appl. No.: 12/301,333

(22) PCT Filed: May 18, 2007

(86) PCT No.: PCT/EP2007/054808

§ 371 (c)(1),
(2), (4) Date: Jan. 6, 2009

(87) PCT Pub. No.: WO2007/135082

PCT Pub. Date: Nov. 29, 2007

(65) Prior Publication Data

US 2009/0183717 A1 Jul. 23, 2009

(30) Foreign Application Priority Data

May 18, 2006 (DE) ..... 10 2006 023 651

(51) Int. Cl.
*F01M 13/04* (2006.01)

(52) U.S. Cl. ..... 123/572

(58) Field of Classification Search ..... 123/572–574, 123/41.86

See application file for complete search history.

(56) References Cited

U.S. PATENT DOCUMENTS

| | | | | |
|---|---|---|---|---|
| 3,166,062 | A | 1/1965 | Yerman | |
| 3,790,931 | A | 2/1974 | Leveraus | |
| 4,607,604 | A | 8/1986 | Kanoh et al. | |
| 5,564,401 | A * | 10/1996 | Dickson | 123/573 |
| 6,161,529 | A * | 12/2000 | Burgess | 123/572 |
| 2005/0279336 | A1 * | 12/2005 | Dworatzek et al. | 123/572 |

FOREIGN PATENT DOCUMENTS

DE 10232044 A1 * 1/2004

* cited by examiner

*Primary Examiner* — M. McMahon

(57) ABSTRACT

Crankcase venting system comprising an oil separator arranged in a housing that separates the housing into an unfiltered air side and a filtered air side, wherein in the area of the unfiltered air side a valve is arranged that is comprised of a valve plate, a pressure spring resting against the valve plate, as well as a valve seat that is closed or opened by means of the valve plate, and wherein the valve is closed off by a lid that is locked or snapped in place.

11 Claims, 4 Drawing Sheets

CRANKCASE VENTING SYSTEM

TECHNICAL FIELD

The invention concerns a crankcase venting system according to the features of independent claim 1.

Such crankcase venting systems are used, for example, in vehicles, construction machines or industrial machines.

DETAILED DESCRIPTION

The invention makes it possible to integrate into a standard crankcase venting system optionally an overpressure valve 20 that vents toward the atmosphere 36 or a bypass valve 34 that bypasses the oil separator 12. Moreover, a signal transducer for a crankcase venting system can be integrated. The signal, for example, by means of an onboard electronic unit, can be provided to the vehicle driver or the machine operator.

Figure 1:
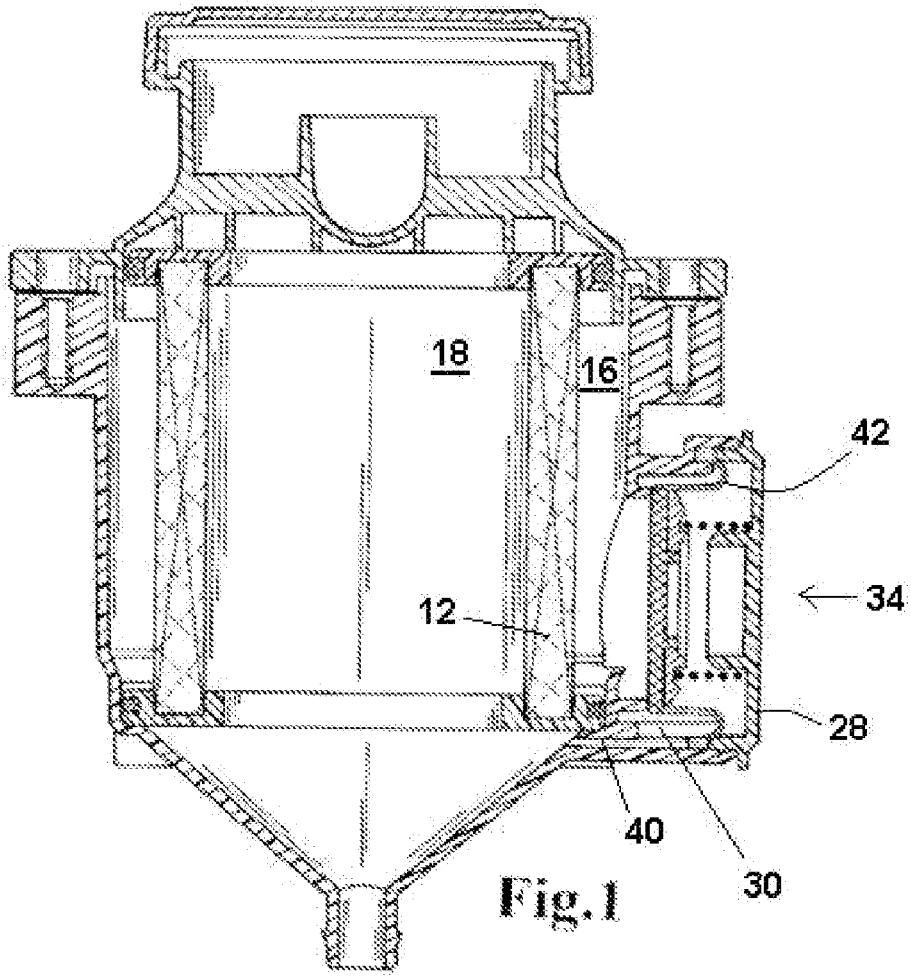
FIG. 1 shows a crankcase venting system.
Figure 2:
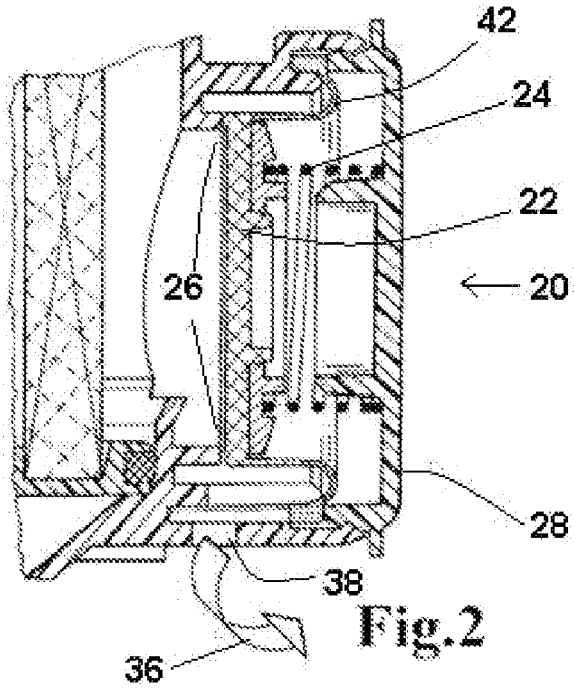
FIG. 2 shows an overpressure valve for a crankcase venting system.
Figure 3:
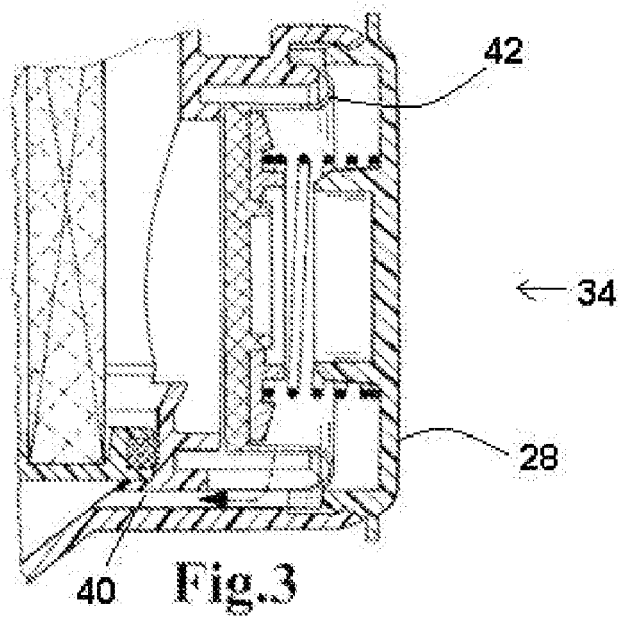
FIG. 3 shows bypass valve for a crankcase venting system.

The starting point of the invention is the desire to provide a compact system that is as small as possible with which, despite its compact configuration, both functions (overpressure valve and bypass valve) can be optionally realized. The invention moreover is directed to realize by an appropriate configuration of the system both functions with same and as few as possible components in order to keep costs for the entire system low. The modifications are realized in the described system, on the one hand, by the advantageous positioning of the valve at the interface between unfiltered side 16 and filtered side 18 of the oil separator and, on the other hand, by interchangeable inserts in the housing mold that optionally form an outlet passage 38 to the atmosphere or a bypass 40 to the filtered side 18. In both valve variants the same diaphragm 42 and the same valve lid 28 are used or can be used. In this way it is possible to realize both functions with the same individual partial components in the context of a standard crankcase venting system. See FIG. 1, FIG. 2, and FIG. 3.

The invention also concerns providing an indicator system for the crankcase venting action. Known are, for example, mechanical indicators at the crankcase venting system that are actuated as a result of pressure differences on a diaphragm. They are comprised in general of a colored indicator pin that is moved into a viewing field. As a result of their configuration, these indicators are part of the crankcase venting system and are located thus directly on a motor where oil must be separated from the crankcase gases. Moreover, general maintenance switches for monitoring air filters are known. The invention provides that triggering an overpressure valve or a bypass valve of a crankcase venting system is monitored by means of an electronic contact. The overpressure valve or the bypass valve provides an emergency function for the crankcase venting system when the oil separator reaches an impermissibly high differential pressure.

The actuation of the overpressure valve 20 has the effect that unfiltered blowby gases reach the atmosphere directly; this is critical with respect to environmental considerations. A bypass valve 34 guides unfiltered blowby gases directly to the filtered side 18 of the filter 12; an extended operation in this mode can cause undesirable contaminations at the turbocharger or charge air cooler which causes power loss of the engine. It is therefore desirable to keep the phase of emergency function as short as possible and to therefore indicate the valve activation to the machine operator or the vehicle driver.

Figure 4:
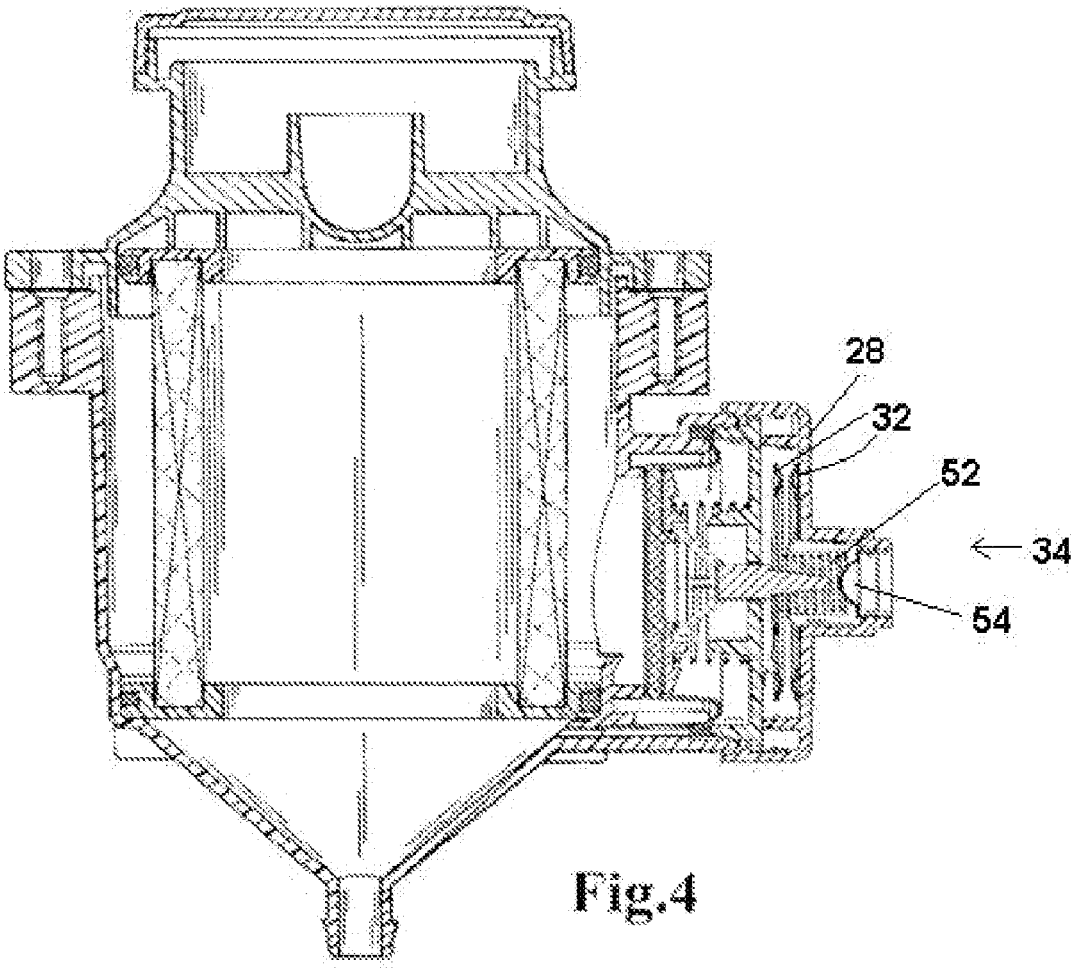
FIG. 4 shows a crankcase venting system with a service switch.
Figure 5:
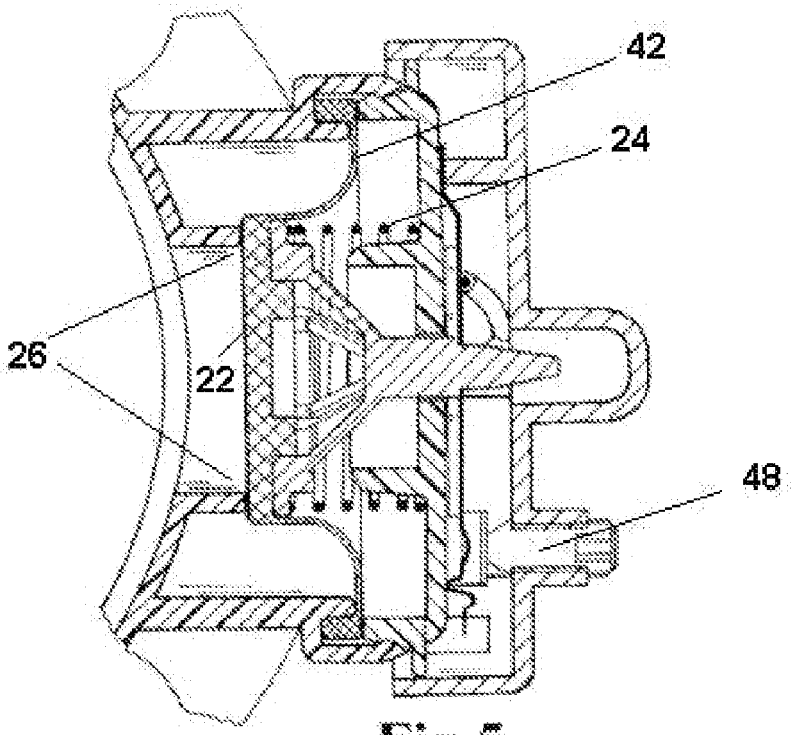
FIG. 5 shows a crankcase venting system with a service switch having an adjusting device.
Figure 6:
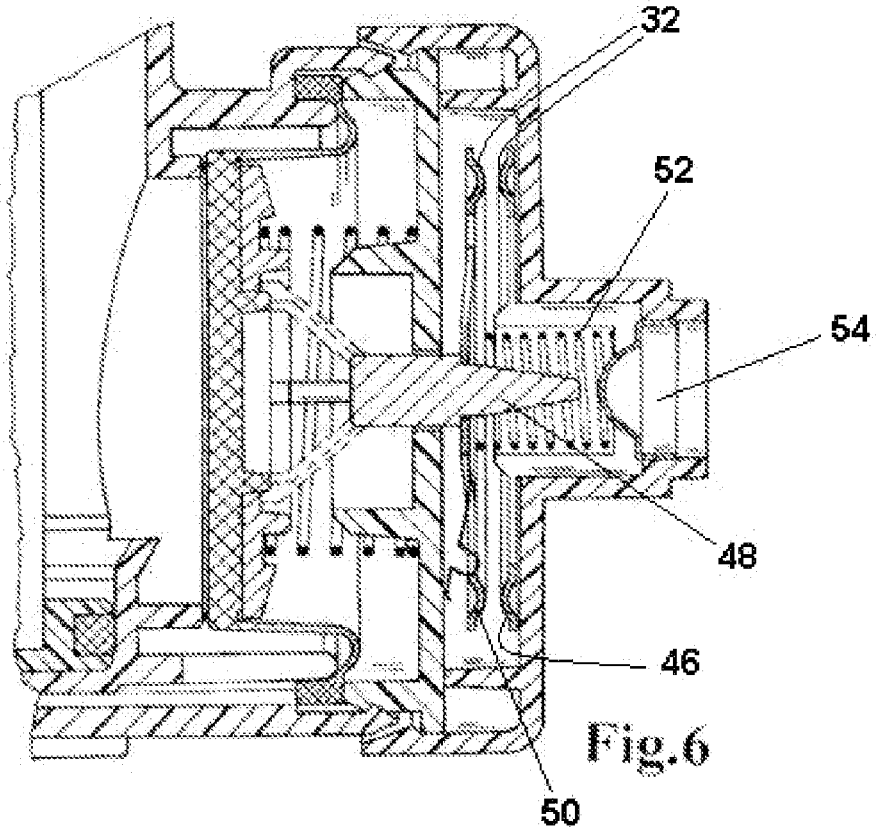
FIG. 6 shows a crankcase venting system with switch pretensioned by a spring and a clamping element.

A switch 32 that upon actuation of the valve triggers an electronic signal serves for monitoring the crankcase venting system and indicates to the machine operator that an element change must be carried out. The invention provides a service switch 32 that is actuated upon movement of a valve body or a diaphragm 42 which movement is caused by overpressure at the unfiltered side 16 of the filter. The switch is constructed such that a simple overpressure valve or bypass valve can be supplemented by the switch function. In this way, in the context of a standard crankcase venting system relatively simple variants, with and without switch functions, can be generated. See in this connection FIGS. 4, 5 and FIG. 6.

In order to inform the machine operator or the vehicle driver of the actuation of the valve the signal of the service switch can be coupled to the onboard electronic unit. By means of the onboard electronic unit the signal can be made available to the machine operator or the vehicle driver, for example, at the dashboard or on a display board. This can be done, for example, by a warning light or an indicator of an onboard computer. Also, a direct supply to the interior or control stand of a machine or a vehicle is possible with which, for example, a warning light is switched on. The interior or control stand means in this context the location where the vehicle driver or the machine operator of the machine or the vehicle is present during regular operation.

The switch is comprised of a fixed contact 46 that, by means of an adjusting device 48, can be calibrated (FIG. 5) and a movable contact 50 that is actuated by means of the valve body 48 movement. The movable contact is moved by a plunger in this connection.

Figure 7:
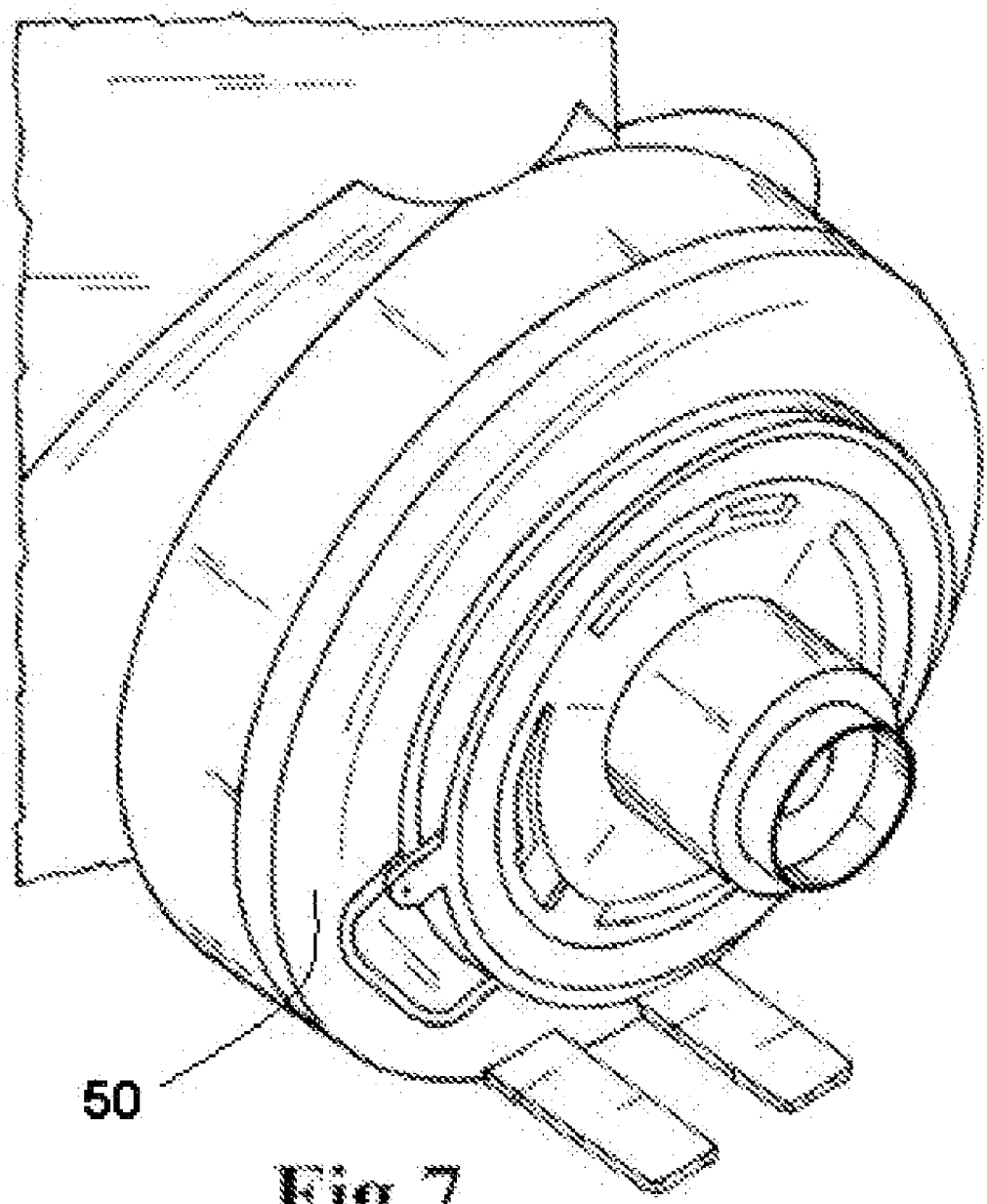
FIG. 7 shows a switch lid with contacts.

The fixed contact 46 is part of the switch lid 50 (FIG. 7). The movable contact is located directly on the diaphragm 42. The contact can be embodied as an insertion part, can be integrated into the diaphragm or can be directly injection-molded with the diaphragm. The movable contact 50 is actuated directly by the valve diaphragm. In this embodiment the calibration of the movable contact 50 is realized by means of a second spring 52 that is pretensioned by means of a clamping element 54. In this way, the calibration of the opening point of the valve and thus of the switching point are accomplished at the same time. In order to detect a one-sided opening movement of the valve body, the contact can also be designed to be annular.

The invention claimed is:

1. Crankcase venting system comprising an oil separator arranged in a housing which separates the interior of the housing into an unfiltered air side and a filtered air side, wherein in the area of the unfiltered air side of said housing a valve is arranged that is comprised of a valve plate, a pressure spring resting against the valve plate, as well as a valve seat that is closed or opened by the valve plate, and wherein the valve is closed off by a lid that is locked or snapped in place and/or welded thereto, wherein the valve is a bypass valve and closes or opens a passage between the unfiltered air side and the filtered air side.

2. Crankcase venting system according to claim 1, wherein the valve has an outlet opening and, when overpressure at the unfiltered air side occurs, this overpressure is relieved through the outlet opening.

3. Crankcase venting system according to one of the preceding claims, wherein on the valve a service switch is provided that is actuated by overpressure at the unfiltered air side of the filter.

4. Crankcase venting system according to claim 3, wherein the service switch sends an electrical signal.

5. Crankcase venting system according to claim 4 wherein by means of the service switch a signal is sent to an onboard electronic unit of a vehicle or a machine.

6. Crankcase venting system according to claim 4 by the electrical signal of the service switch a visual or acoustic signal is triggered.

7. Crankcase venting system according to claim 6, wherein the visual or acoustic signal is triggered in the interior of the vehicle or at the control stand of the machine.

8. Crankcase venting system according to claim 4 wherein the switch has a fixed contact that can be calibrated by means of an adjusting device.

9. Crankcase venting system according to claim 4 wherein the switch comprises a movable contact that can be calibrated by means of an adjusting device.

10. Crankcase venting system according to claim 3, wherein said valve includes a diaphragm responsive to differences in pressure between said unfiltered side and either said filter side or atmospheric pressure, wherein said diaphragm is operable to open said valve plate from said valve seat in response to said pressure difference;

said pressure spring tensioning said valve plate and operable to set an opening point of said valve;

wherein said service switch comprises a fixed electrical contact;

a moveable electrical contact operable by said valve plate or said diaphragm, said moveable electrical contact arranged to contact said fixed electrical contact, wherein said service switch detects said opening of said valve.

11. Crankcase venting system according to claim 10, further including a second spring calibrated to pretension said moveable contact and said valve, wherein said calibration of said second spring is operable to set said opening point of said valve and a switching point of said service switch at the same time; and a calibrating clamping element arranged to provide said pretensioning of said second spring, setting said opening point and said switching point.

* * * * *